US005174460A

United States Patent [19]

Minnette

[11] Patent Number: 5,174,460

[45] Date of Patent: Dec. 29, 1992

[54] DUAL SEAL CLOSURE-ADAPTOR

[75] Inventor: Jeffrey C. Minnette, Evansville, Ind.

[73] Assignee: Sunbeam Plastics Corporation, Evansville, Ind.

[21] Appl. No.: 841,705

[22] Filed: Feb. 26, 1992

[51] Int. Cl.[5] ..... B65D 41/34

[52] U.S. Cl. ..... 215/335; 215/330; 215/343

[58] Field of Search ..... 215/329, 330, 335, 343; 220/288, 304

[56] References Cited

U.S. PATENT DOCUMENTS

| | | | |
|---|---|---|---|
| Re. 6,613 | 8/1875 | Fry . | |
| 15,802 | 9/1856 | Espy . | |
| 40,338 | 10/1863 | Fry . | |
| 58,281 | 9/1866 | Olry . | |
| 73,680 | 1/1868 | Wattis, Jr. . | |
| 564,878 | 7/1896 | Frisch | 215/329 X |
| 3,092,281 | 6/1963 | Davidson | 215/329 X |
| 3,425,589 | 2/1969 | Lipske et al. | 220/304 |
| 3,434,615 | 3/1969 | Barletta | 215/47 |
| 3,871,545 | 3/1975 | Bereziat | 215/330 X |
| 3,905,509 | 9/1975 | Markowitz | 215/330 X |
| 4,106,654 | 8/1978 | Jones | 215/329 |
| 4,941,580 | 7/1990 | Julian . | |

*Primary Examiner*—Allan N. Shoap
*Assistant Examiner*—Nova Stucker
*Attorney, Agent, or Firm*—Gifford, Groh, Sprinkle, Patmore and Anderson

[57] ABSTRACT

An adaptor and a closure are formed with precision surfaces as by injection molding so that the closure can be attached to the adaptor without the use of excessive force to create a secondary seal. The adaptor-closure can then be attached to an imprecisely formed threaded container such as an extrusion-blow molded bottle to create a primary seal. The adaptor is permanently retained on the container with securing by thread wedging, cooperating ratchet teeth or the like.

13 Claims, 1 Drawing Sheet

DUAL SEAL CLOSURE-ADAPTOR

BACKGROUND OF THE INVENTION

1. Field of the Invention

This invention relates to container closures. More particularly this invention relates to a replaceable closure or cap for use on an imprecisely formed container finish, for example, a threaded cap for use on the threaded neck finish of an extrusion-blow molded bottle container.

2. Description of the Related Art

Typically containers for fluid household products are made with imprecisely formed neck finishes so that keeping the cap sealed to the container during transportation from the manufacturer/bottler to the consumer's shelf is a problem.

Plastic containers are normally extrusion-blow molded with tolerances of ±0.015" or greater. Rolled metal can threads and glass containers can have even wider tolerances. When the typical plastic molded container for automotive products such as motor oil, antifreeze or windshield washer solvent or household products such as laundry detergent, drain cleaners and the like are capped, excessive torque is used to effect the seal. This produces a package that will meet existing child resistant governmental restrictions that it can't be opened by a 4-5 year old child but can normally be opened by an 18-45 year old adult. The high closing and consequent high opening torque still makes the package user unfriendly, particularly to the arthritic afflicted or older person who may not be able to open the package at all. Also resealing of the package may be impossible, but this is usually ignored since household shelf storage does not usually require such resealing.

SUMMARY OF THE INVENTION

The present invention provides means for supplying a cap in a user friendly environment to seal a container having an imprecise neck finish by the use of primary and secondary seals in an adaptor-closure combination.

The adaptor and closure are precision formed as by injection or compression molding to produce precision surfaces on both parts which provide a primary seal of the adaptor to the container finish and a reusable low torque secondary seal between the closure and the adaptor. The closure, sealed to the adaptor, is supplied as a unit to the bottler who seals the adaptor to the container by the use of conventional capping machinery. High torque can be used to effect the primary seal of the adaptor to the container as this will be a permanent seal not intended to be broken by the ultimate consumer.

The plastic adaptor is molded with precision surfaces which include attachment means such as precision external threads or a snap over bead to secure a closure to the adaptor and a sealing surface. The adaptor is also molded with internal threads which engage the imprecise external threads on the container establishing the primary seal. Means are provided for securing the adaptor to the container to prevent unthreading of the adaptor from the container. The closure is molded with precision surfaces including a sealing surface and attachment means which is complementary to the adaptor attachments means for removable attachment of the closure to the adaptor creating the secondary seal between the sealing surfaces of the closure and the adaptor.

The primary seal can include a resilient gasket which is compressed between the adaptor and the container to be part of the securing means and producing the primary seal as the adaptor is threaded onto the container. The gasket may be a conventional foamed rubber composition, or it can be of other materials such as a hot melt adhesive.

The securing means can provide wedging between the internal adaptor threads and the external container threads. For example, the container can have a neck which terminates in a lip, and the securing means can include an annular seating surface on the adaptor which acts against the lip as the adaptor is threaded onto the container causing the wedging action between the internal adaptor threads and the external container neck threads. The primary seal can be effected between the annular seating surface on the adaptor and the container neck lip.

In another embodiment, the container can have a shoulder and the adaptor a skirt containing internal threads so that the securing means includes the bottom of the skirt which acts against the container shoulder as the adaptor is threaded onto the container causing the wedging action between the internal adaptor threads and the external container neck threads.

In other embodiments, the securing means can include stop means on the adaptor which engages complementary stop means on the container. This can take the form of ratchet teeth on the adaptor which engage ratchet teeth on the container allowing threading of the adaptor onto the container but preventing unthreading of the adaptor from the container. These ratchet teeth can be located above or below the threads of the container neck and adaptor and can be radially engaging or axially engaging.

The attachment means between the adaptor and closure can include external threads on the adaptor and complementary internal threads on the closure. The adaptor can have an outer annular skirt which contains the internal threads for engaging the external threads on the container, and this outer skirt can have external threads for engaging the internal threads on the closure. The sealing surfaces for the adaptor and closure can be inner skirts which engage to effect a resilient low torque resealable secondary seal when the closure is threaded onto the adaptor.

BRIEF DESCRIPTION OF THE DRAWING

The advantages of the present invention will be more apparent from the following detailed description when considered in connection with the accompanying drawing wherein.

DESCRIPTION OF THE PREFERRED EMBODIMENTS

Figure 1:
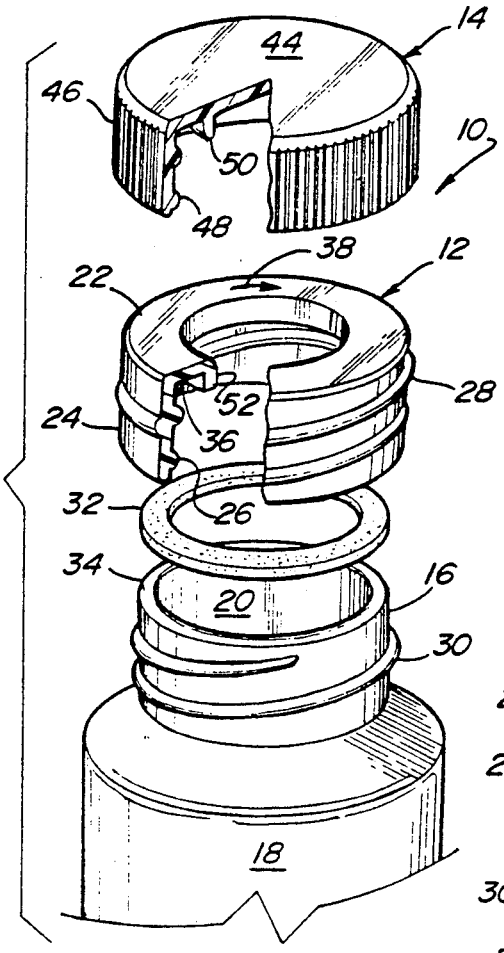
FIG. 1 is an exploded perspective view of the closure-adaptor of this invention showing the assembly of the closure cap to the adaptor and the adaptor to a container neck with the use of an intermediate gasket or insert.
Figure 2:
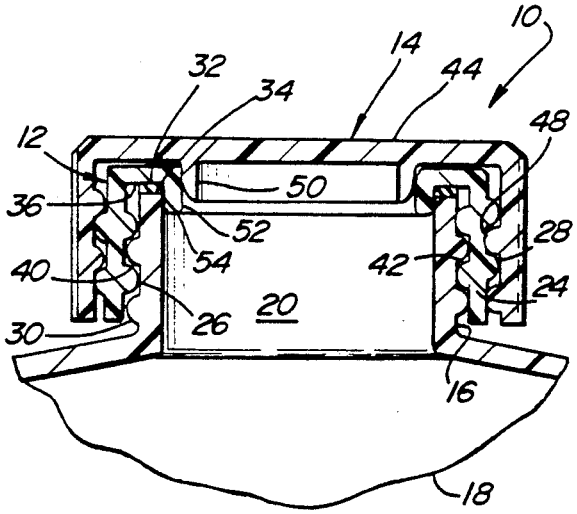
FIG. 2 is a partial elevational view in cross section of the closure-adaptor of FIG. 1 shown in the assembled condition with a primary seal between the adaptor and container neck and a secondary seal between the closure and adaptor.

Referring to FIGS. 1 and 2, the dual seal closure-adaptor 10 of the present invention is shown as including an adaptor 12 and closure 14 which is applied to the neck 16 of a container 18 to removably seal access to the contents of the container through opening 20.

Both the adaptor 12 and the closure 14 are precision formed as by injection or compression molding to produce precision surfaces primarily to produce a reusable secondary seal between the adaptor and closure which does not require excessive force or the use of inserts or gaskets and the like to effect a liquid tight seal.

Adaptor 12 has an annular top 22 and an outer skirt 24 depending from its periphery. Outer skirt 24 carries container attachment means in the form of internal threads 26 and closure attachment means in the form of external threads 28.

Container 18 is produced by conventional extrusion blow molding which produces imprecisely formed attachment means in the form of external threads 30 on the container neck 16. When the term "imprecisely formed" is used, it is meant that close tolerances or shapes cannot be maintained. For example, in extrusion-blow molding of a plastic container or in forming a glass or metal container, tolerances usually exceed ± 0.015". Thus, it is not possible to provide a reliable, resealable, and low closing and opening torque closure for the container even where the closure is formed with precision surfaces having a tolerance of ±0.003" or less. Therefore, when the adaptor 12 is threaded onto the container neck 16, securing means in addition to the engagement of internal thread 26 with external thread 30 must be used to keep the adaptor 12 permanently sealed on the container neck 16. The securing means can include, but usually requires more than, gasket or insert 32 which is compressed between container neck lip 34 and the annular surface 36 of adaptor 12.

As better visualized in conjunction with FIG. 2, the securing means can provide wedging between the internal adaptor threads 26 and the external container threads 30. This is accomplished by the abutment of container neck lip 34 with the annular seating surface 36, with or without the interposition of insert 32 which will be fully compressed.

More precisely, threading on the adaptor 12 in a clockwise direction as seen by arrow 38 in FIG. 1 will, with reference to FIG. 2, wedge the lower surface 40 of the container neck thread 30 and the container neck lip 34 between the upper surface 42 of the adaptor thread 26 and the annular seating surface 36 on the inside of adaptor top 22.

Closure or cap 14 has a top 44 with an annular outer skirt 46 depending from its periphery. This outer skirt 46 carries attachment means in the form of internal threads 48 which engage the complementary external threads 28 of adaptor 12.

Since both the adaptor 12 and closure 14 have been precision molded or have been formed with precision surfaces as by injection molding, a resilient secondary seal can be established between the parts without the use of liners or gaskets, at torques with which the ultimate customer is comfortable; the package has been made "user friendly".

Figure 3:
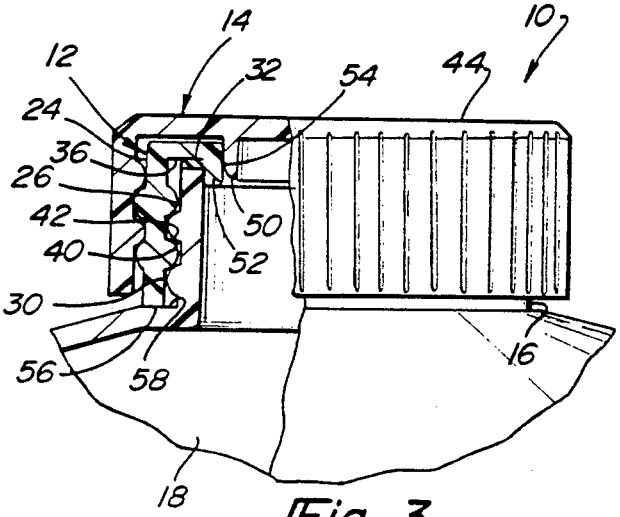
FIG. 3 shows an alternate elevational view partially in cross section showing a modification of the means for permanently securing the adaptor to the container neck.
Figure 4:
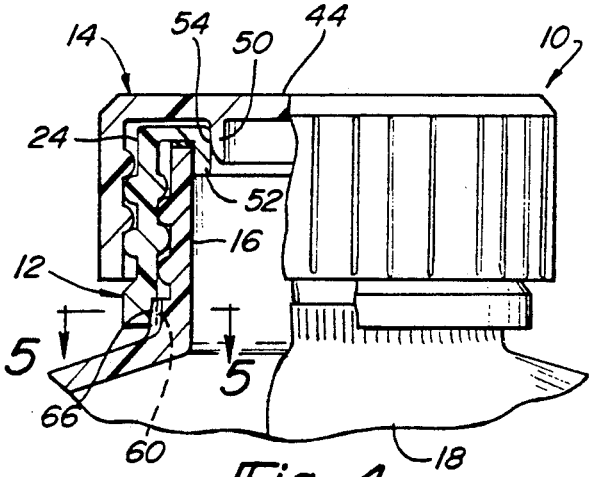
FIG. 4 is an elevational view partially in cross section showing another alternate form of permanently securing the adaptor to the container neck by the use of ratchet teeth.

In the embodiments illustrated, the closure 14 has been provided with a resilient inner skirt 50 and the adaptor 12 has been provided with an inner skirt 52 which may be tapered inwardly as shown in FIGS. 1–4. When the closure 14 is threaded onto the adaptor 12, the closure inner skirt 50 is guided along the tapered inner skirt 52 of the adaptor to form a resilient seal at 54 as shown in FIGS. 2, 3 and 4. It will be appreciated that other resilient annular sealing surfaces can be provided between the closure 14 and adaptor 12. For example, the cap or closure inner skirt can be in the form of a downwardly extending fin or rib which contacts the annular top 22 of the adaptor.

Referring to FIG. 3, the means for permanently securing the adaptor 12 to the container neck 16 can be by wedging the internal threads 26 of the adaptor with the external threads 30 of the container as in the FIG. 2 embodiment, but accomplished by the abutment of the bottom 56 of the adaptor outer skirt 24 with a shoulder 58 on the container 18. More precisely, when the adaptor 12 is threaded onto the container neck 16 in the direction of arrow 38 shown in FIG. 1, the wedging action as shown in FIG. 3 occurs between the upper surface 42 of the adaptor thread 30 and lower surface 56 of the adaptor skirt 24 between the lower surface 40 of the bottle thread 30 and the upwardly facing shoulder 58 of the bottle 18 respectively. In this instance, the liner 32 would not be fully compressed as the wedging force will not be transmitted through the liner.

Figure 5:
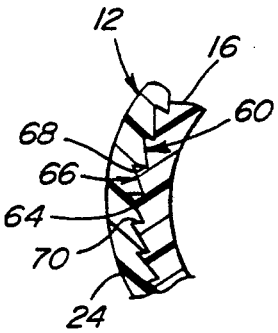
FIG. 5 is a partial cross sectional view along line 5—5 of FIG. 4 showing the inter-engagement of ratchet teeth which serve as the permanent securing means.

FIGS. 4 and 5 show securing the internally threaded adaptor 12 to the container neck 16 by the use of cooperating ratchet teeth. inwardly directed ratchet teeth 60 at the bottom of adaptor outer skirt 24 have ramp surfaces 62 which slide over ramp surfaces 64 on outwardly directly ratchet teeth 66 of container neck 16 as the adaptor is being threaded onto the container neck. Substantially radially e tending stop surfaces 68 on adaptor ratchet teeth 60 coact with substantially radially extending stop surfaces 70 on container ratchet teeth 66 to prevent unthreading of the adaptor from the container neck when the closure 14 is unthreaded from the adaptor. It should be noted that these ratchet teeth could be positioned above the container and adaptor threads 30 and 26. It will also be apparent that the ratchet teeth can be axially extending so as to project upwardly from the container neck lip 34 and downwardly form the annular seating surface 36 on adaptor 12 as these surfaces are indicated in FIG. 2. Such an arrangement is shown in U.S. Pat. No. 4,747,498. In a similar manner, the ratchet teeth could extend axially downwardly from the bottom 56 of the adaptor outer skirt 24 and axially upwardly from the container shoulder 58 as these surfaces are depicted in FIG. 3.

It will also be apparent that other means can be used to permanently secure the adaptor to the container neck such as the use of a snap bead as shown in U.S. Pat. No. 4,727,999.

The embodiments of the invention in which an exclusive property of privilege is claimed are defined as follows:

1. The combination of an adaptor and a closure for providing primary and secondary seals and a removable cap on a neck of a container having an imprecise external thread and an imprecise sealing surface, comprising in combination:

a plastic adaptor molded with precision surfaces including precision attachment means for fastening a closure to said adaptor and a precision sealing surface and further including an internal thread for engaging the imprecise external thread on said container to establish said primary seal between said adaptor and the imprecise sealing surface of said container;

securing means for securing said adaptor to said container to prevent unthreading of said adaptor from said container;

a plastic closure molded with precision surfaces including a precision sealing surface and precision attachment means complementary to said adaptor attachment means for removable attachment thereto creating said secondary seal between the precision sealing surface of said closure and the precision sealing surface of said adaptor;

at least one of said plastic adaptor and plastic closure including an axially extending tubular projection having its respective precision sealing surface; and wherein said adaptor has a through bore, which upon removal of said closure from said adaptor, provides open access to an interior of said container.

2. The combination according to claim 1 wherein said primary seal includes a resilient gasket which is compressed between a seating surface on said adaptor and the imprecise sealing surface on said container when said adaptor is threaded onto said container.

3. The combination according to claim 1 wherein said securing means provides wedging between said internal adaptor threads and said imprecise external container thread.

4. The combination according to claim 3 wherein said container has a neck terminating in a lip constituting said imprecise sealing surface and said securing means includes an annular seating surface on said adaptor which acts against said lip as said adaptor is threaded onto said container neck causing the wedging action between the internal adaptor threads and the container neck threads.

5. The combination according to claim 4 wherein said primary seal is effected between the annular seating surface on said adaptor and said container neck lip.

6. The combination according to claim 5 wherein said primary seal includes a resilient gasket which is compressed between said annular seating surface on said adaptor and said container neck lip.

7. The combination according to claim 3 wherein said container has a shoulder and said adaptor has a skirt container said internal threads, and said securing means includes the bottom of said skirt which acts against said should as said adaptor is threaded onto said container causing the wedging action between the internal adaptor threads and the external container neck threads.

8. The combination according to claim 1 wherein said securing means includes stop means on said adaptor which engages stop means on said container.

9. The combination according to claim 8 wherein said stop mean includes ratchet teeth on said adaptor which engage ratchet teeth on said container allowing threading of said adaptor on to said container but preventing unthreading of said adaptor from said container.

10. The combination according to claim 9 wherein said ratchet teeth are located below said imprecise external neck threads, and said ratchet teeth on said adaptor are below said internal adaptor threads.

11. The combination according to claim 9 wherein said ratchet teeth on said adaptor extend radially inward and said ratchet teeth on said container extend radially outward.

12. The combination according to claim 1 wherein said attachment means includes a precision external thread on said adaptor and a complementary precision internal thread on said closure.

13. The combination according to claim 12 wherein said adaptor has an outer annular skirt containing said internal thread for engaging the external thread on said container and containing said precision external thread for engaging the precision internal thread on said closure, and the precision sealing surface of said adaptor and the precision sealing surface of said closure both being on a said axially extending tubular projection which constitute inner skirts which engage to effect said secondary seal when said closure is threaded onto said adaptor.

* * * * *